US010302091B2

(12) United States Patent
Cho et al.

(10) Patent No.: US 10,302,091 B2
(45) Date of Patent: May 28, 2019

(54) AIR BLOWER AND AIR CONDITIONER HAVING THE SAME

(71) Applicant: LG ELECTRONICS INC., Seoul (KR)

(72) Inventors: Namjoon Cho, Seoul (KR); Kamgyu Lee, Seoul (KR); Dongkeun Yang, Seoul (KR); Baikyoung Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 173 days.

(21) Appl. No.: 15/238,379

(22) Filed: Aug. 16, 2016

(65) Prior Publication Data

US 2017/0051749 A1 Feb. 23, 2017

(30) Foreign Application Priority Data

Aug. 17, 2015 (KR) ..... 10-2015-0115521

(51) Int. Cl.

| | |
|---|---|
| ***F04D 25/08*** | (2006.01) |
| ***F24F 7/007*** | (2006.01) |
| ***F24F 7/06*** | (2006.01) |
| ***F04D 27/00*** | (2006.01) |
| ***F04D 29/28*** | (2006.01) |
| ***F04D 29/42*** | (2006.01) |
| ***F04D 29/44*** | (2006.01) |
| ***F04D 29/66*** | (2006.01) |

(52) U.S. Cl.

CPC ..... *F04D 25/08* (2013.01); *F04D 27/006* (2013.01); *F04D 29/281* (2013.01); *F04D 29/424* (2013.01); *F04D 29/441* (2013.01); *F04D 29/663* (2013.01); *F24F 7/007* (2013.01); *F24F 7/065* (2013.01)

(58) Field of Classification Search

CPC .... F04D 29/281; F04D 29/283; F04D 29/403; F24F 7/007

See application file for complete search history.

(56) References Cited

U.S. PATENT DOCUMENTS

| | | | | |
|---|---|---|---|---|
| 7,144,219 | B2 * | 12/2006 | Hancock | F04D 17/02 415/212.1 |
| 7,473,070 | B2 * | 1/2009 | Song | H05B 6/6423 415/119 |
| 7,549,842 | B2 * | 6/2009 | Hanson | B60H 1/00471 415/204 |
| 7,568,338 | B2 * | 8/2009 | Noelle | F01D 9/042 415/199.1 |

(Continued)

FOREIGN PATENT DOCUMENTS

| | | |
|---|---|---|
| CN | 102536907 A | 7/2012 |
| CN | 102966598 A | 3/2013 |

(Continued)

*Primary Examiner* — Patrick Hamo
(74) *Attorney, Agent, or Firm* — Dentons US LLP

(57) ABSTRACT

An air blower including a convex part protruding away from the rotation axis of an impeller. When arbitrary cross-sectional surfaces are provided by cutting the convex part in a parallel direction with the rotation axis, each point of the inner circumferential surface of the convex part, which has a maximum distance from the rotation axis, leans toward a first plate of the first and second plates, at which inlets are formed.

12 Claims, 8 Drawing Sheets

(56) References Cited

U.S. PATENT DOCUMENTS

| | | | | |
|---|---|---|---|---|
| 7,591,633 | B2 * | 9/2009 | Hancock | F04D 29/4226 415/206 |
| 9,964,118 | B2 * | 5/2018 | Park, II | F04D 29/424 |
| 2004/0253101 | A1 | 12/2004 | Hancock | |
| 2007/0059167 | A1 | 3/2007 | Hancock | |
| 2007/0197156 | A1 | 8/2007 | Hanson et al. | |
| 2009/0232648 | A1 * | 9/2009 | Wu | F04D 29/4226 415/204 |
| 2012/0121403 | A1 * | 5/2012 | Clemons | F01D 17/162 415/208.1 |

FOREIGN PATENT DOCUMENTS

| | | | |
|---|---|---|---|
| EP | 2 584 201 | A1 | 4/2013 |
| FR | 2 868 813 | A1 | 10/2005 |
| KR | 10-2013-0041639 | A | 4/2013 |

* cited by examiner

AIR BLOWER AND AIR CONDITIONER HAVING THE SAME

CROSS-REFERENCE TO RELATED APPLICATION

The application claims priority under 35 U.S.C. § 119 and 35 U.S.C. § 365 to Korean Patent Application No. 10-2015-0115521, filed Aug. 17, 2015, whose entire disclosure is hereby incorporated by reference.

BACKGROUND OF THE INVENTION

1. Field of the Invention

An air blower and an air conditioner having the same.

2. Description of the Related Art

An air blower is a device that generates airflow. The air blower may be applied to an air conditioner for conditioning indoor air to blow air for cooling or heating an indoor space.

The air blower generally includes a rotation motor and a centrifugal fan rotating at high speed to generate a centrifugal force. The centrifugal fan exhausts air through centrifugal force out of the centrifugal fan.

The centrifugal fan generally includes a main plate connected to a driving shaft of the motor, an impeller including a plurality of blades arranged on the main plate in a circumferential direction, and a fan housing for accommodating the impeller.

The fan housing generally includes an inlet suctioning (e.g., sucking) air in a rotation axis direction, and an outlet exhausting air in a direction perpendicular to the rotation axis after air is extruded in a radial direction by rotation of the impeller. The fan housing may have a scroll-shaped flow path between the impeller and the fan housing to guide air toward the outlet.

A double suction type blower generally includes an impeller having blades each disposed at both sides of a main plate, a fan housing having inlets each disposed at both side of the main plate, and a rotation motor disposed at one of the inlets. In such a double suction type blower, when air is suctioned through the inlet at which the motor is attached, the motor operates as a resistance to the airflow. Thereby, deviation of airflows at both inlets occurs. This causes a fan to be off-balance and, as such, efficiency and performance of the fan are decreased and power consumption and noise are increased.

SUMMARY OF THE INVENTION

The present disclosure is provided in view of the above problems. An object of the present disclosure is to provide a double suction type blower having a centrifugal fan, and an air conditioner including the same, in which an impeller may be rotated in balanced way.

It is another object of the present invention to provide an air blower capable of uniformly suctioning air through both inlets although resistances of the airflows at both inlets are different, and an air conditioner including the same.

It is another object of the present invention to provide an air blower preventing abnormal noise and an air conditioner including the same.

In accordance with an aspect of the present invention, the above and other objects can be accomplished by the provision of an air blower including a rotatable impeller, a fan housing in which the impeller is disposed, the fan housing including first and second inlets suctioning air current along a rotation axis of the impeller and an outlet exhausting air current in a direction perpendicular to the rotation axis, a motor disposed outside the fan housing, and a driving shaft expanding along the rotation axis to be connected to the impeller, the driving shaft being rotated by the motor, wherein, the fan housing includes a first plate at which the first inlet is formed, a second plate providing a space between the first plate and the second plate to accommodate the impeller, the second plate at which the second inlet is formed, and a sidewall connecting the first plate to the second plate, the sidewall expanding at an outer side of the impeller in a circumferential direction to guide air suctioned through the first and second inlets to the outlet, and the impeller includes a main plate coupled to the driving shaft, the main plate having a first side facing the first inlet and a second side facing the second inlet, a plurality of first blades arranged on the first side in a circumferential direction, and a plurality of second blades arranged on the second side in a circumferential direction, and the motor is disposed at the first inlet side, the sidewall comprises a convex part protruding away from the rotation axis, and when arbitrary cross-sectional surfaces are provided by cutting the convex part in a parallel direction with the rotation axis, in each cross-sectional surface, each of points of an inner circumferential surface of the convex part, which has a maximum distance from the rotation axis, locates closer to the first plate than the second plates.

In accordance with another aspect of the present invention, there is provided an air blower including a motor, and first and second centrifugal fans disposed at opposite sides of the motor, the first and second centrifugal fans being rotated by the motor, wherein each of the first and second centrifugal fans includes a rotatable impeller, a fan housing in which the impeller is disposed, the fan housing including first and second inlets suctioning air current along a rotation axis of the impeller and an outlet exhausting air current in a direction perpendicular to the rotation axis, and wherein the fan housing includes a first plate at which the first inlet is formed, a second plate providing a space between the first plate and the second plate to accommodate the impeller, the second plate at which the second inlet is formed, and a sidewall connecting the first plate to the second plate, the sidewall expanding at an outer side of the impeller in a circumferential direction to guide air suctioned through the first and second inlets to the outlet, the impeller includes a main plate coupled to a driving shaft rotated by the motor, the main plate having a first side facing the first inlet and a second side facing the second inlet, a plurality of first blades arranged on the first side in a circumferential direction, and a plurality of second blades arranged on the second side in a circumferential direction, and the sidewall comprises a convex part protruding away from the rotation axis, when arbitrary cross-sectional surfaces are provided by cutting the convex part in a parallel direction with the rotation axis, in each cross-sectional surface, each of points of an inner circumferential surface of the convex part, which has a maximum distance from the rotation axis, locates closer to the first plate than the second plate, and in the first and second centrifugal fans, the inlets are disposed at opposite sides of the motor.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings:

FIG. 4(*b*) is a cross-sectional view at a point of θ=180° in the air blower 110*a* taken along line B-B of FIG. 3;

FIG. 4(*c*) is a cross-sectional view at a point of θ=270° in the air blower 110*a* taken along line A-A of FIG. 3;

FIG. 4(*d*) is a cross-sectional view at a point of θ=0° in the air blower 110*a* taken along line B-B of FIG. 3;

FIG. 5(*b*) is a partially enlarged view of FIG. 5(*a*);

FIG. 6(*b*) is a partially enlarged view of FIG. 6(*a*).

DETAILED DESCRIPTION OF THE PREFERRED EMBODIMENTS

Advantages and features of the present disclosure and a method of achieving the same will be more clearly understood from embodiments described below with reference to the accompanying drawings. However, the present disclosure is not limited to the following embodiments but may be implemented in various different forms. The embodiments are provided merely to complete disclosure of the present disclosure and to fully provide a person having ordinary skill in the art to which the present disclosure pertains with the category of the disclosure. The disclosure is defined only by the category of the claims. Wherever possible, the same reference numbers will be used throughout the specification to refer to the same or like elements.

Figure 1:
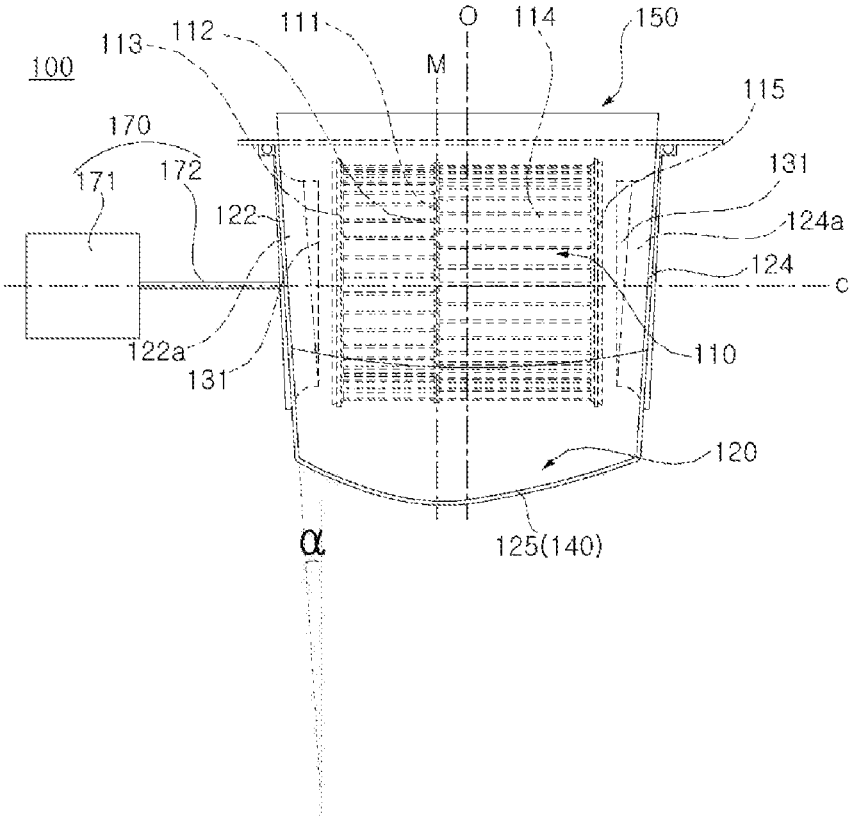
FIG. 1 is a view illustrating an air blower according to an embodiment of the present disclosure.
Figure 2:
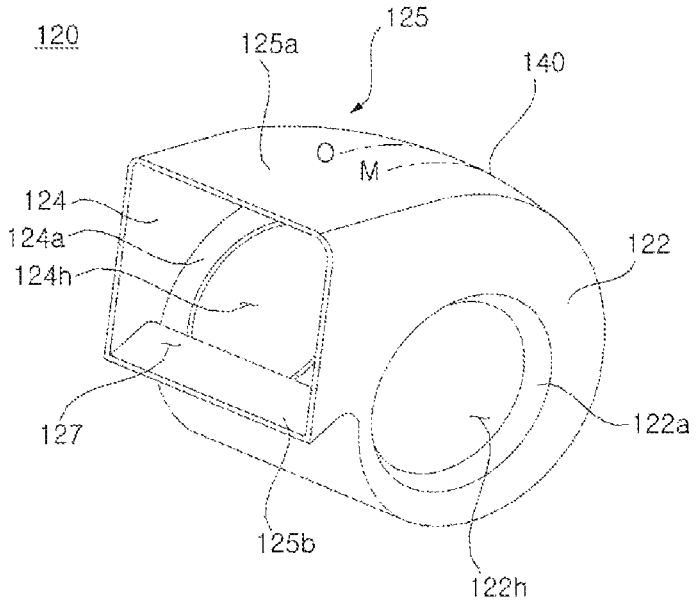
FIG. 2 is a perspective view of a fan housing.
Figure 3:
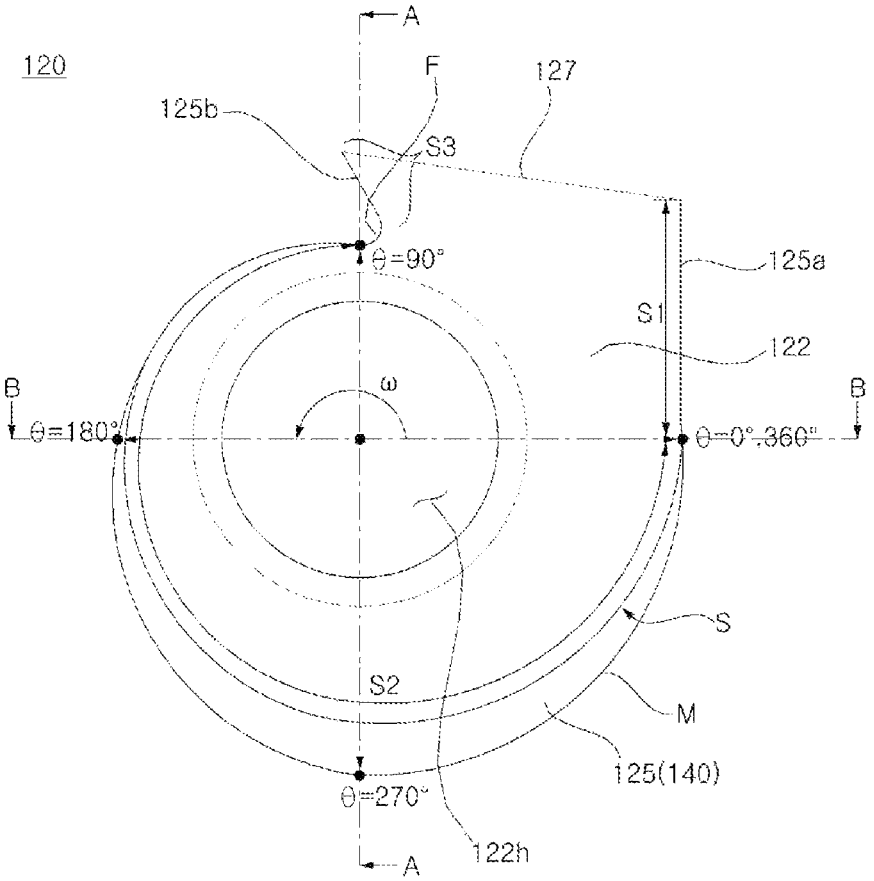
FIG. 3 is a plan view of the fan housing.
Figure 4A:
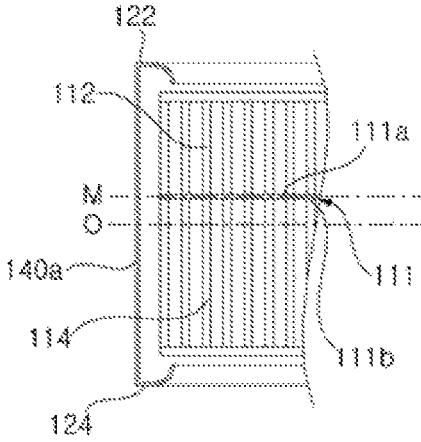
FIG. 4(*a*) is a cross-sectional view at a point of θ=90° in the air blower 110*a* taken along line A-A of FIG. 3.
Figure 4B:
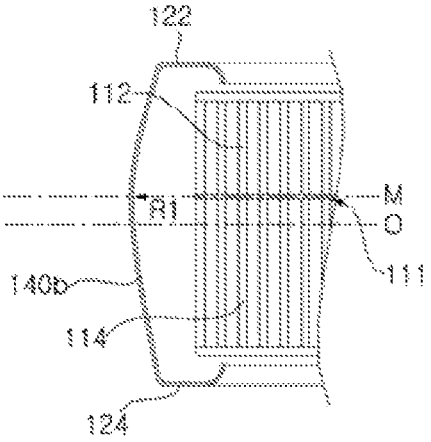
Figure 4C:
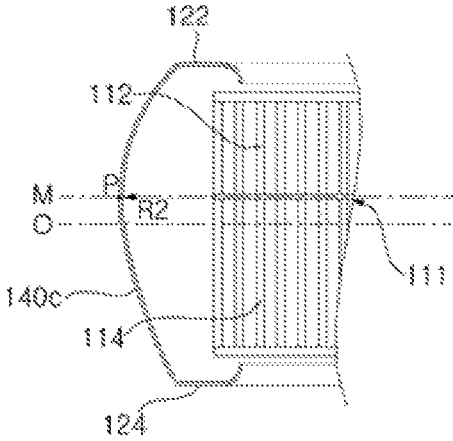
Figure 4D:
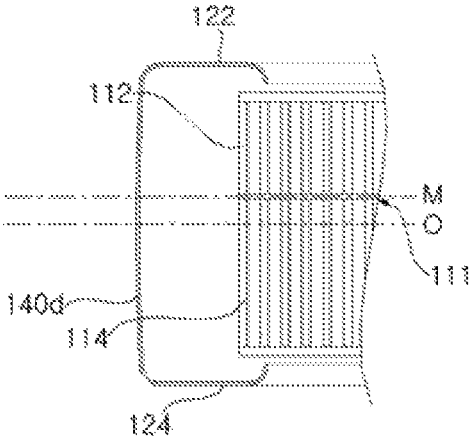

FIG. 1 is a view illustrating an air blower according to an embodiment of the present disclosure. FIG. 2 is a perspective view of a fan housing. FIG. 3 is a plan view of the fan housing. FIGS. 4(*a*)-(*d*) are views illustrating constituents of the air blower.

Referring to FIG. 1, the air blower 100*a* may include a centrifugal fan 150 and a driver 170 driving the centrifugal fan 150.

The centrifugal fan 150 may include an impeller 110 being rotatably disposed therein, and a fan housing in which accommodates the impeller 110.

The driver 170 may include a motor 171 disposed outside the housing 120 and a driving shaft 172 rotated by the motor while expanding along a rotation axis C of the impeller.

The fan housing 120 may include inlets 122*h* and 124*h* for suctioning air current along the rotation axis C of the impeller 110, and an outlet 127 for exhausting air current in a direction perpendicular to the rotation axis C.

The fan housing 120 may include a first plate 122, at which a first inlet 122*h* is formed, and a second plate 124, at which a second inlet 124*h* is formed. Accordingly, the second plate 124 may introduce air current in an opposite direction to the first inlet 122*h*. The first plate 122 and the second plate 124 provide a space to accommodate the impeller 110.

As illustrated, intake guides 122*a* and 124*a* may be formed along circumferences of the inlets 122*h* and 124*h*, respectively, and may each have a ring shape which protrudes inside the fan housing 120. It is understood that the intake guides 122*a* and 124*a* are not limited to having a ring-like shape. An orifice 131 may be inserted into an inner space surrounded by each of the intake guides 122*a* and 124*a*.

The impeller 110 may include a main plate 111 and a plurality of blades 112 and 114 disposed at both sides of the main plate 111. The main plate 111 may be coupled to the driving shaft 172. The main plate 111 may include a first side 111*a* facing the first inlet 122*h* and a second side 111*b* facing the second inlet 124*h*. A plurality of first blades 112 may be arranged at the first side 111*a* in a circumferential direction. A plurality of second blades 114 may be arranged at the second side 111*b* in a circumferential direction.

One end of each of the first blades 112 may be connected to each other by a first rim 113, which is preferably ring-shaped. Similarly, one end of each of the second blades 114 may be connected to each other by a second rim 115, which is preferably ring-shaped.

The first plate 122 and the second plate 124 may be connected to each other by a sidewall 125. The sidewall 125 expands at outside the impeller 110 in a circumferential direction. The sidewall 125 guides air suctioned through the first inlet 122*h* and the second inlet 124*h* to the outlet 127.

The distance between the first plate 122 and the second plate 124 may be increased toward the outlet 127. As illustrated in FIG. 1, the first plate 122 and the second plate 124 may be arranged symmetrical about a plane O. Accordingly, each of the first plate 122 and the second plate 124 is provided at an angle α with respect to the main plate 111.

The outlet 127 has a larger area such that air current is easily diffused and well-exhausted through the outlet 127. Thereby, air current may be exhausted to the entire space (e.g., an interior space of casing 2, see FIGS. 5 and 6), at which the air blower 100*a* is attached.

The sidewall 125 may include a convex part 140 protruding away from the rotation axis C. The sidewall 125 may include a flat plane section 125*a* extending from the outlet 127 and a curved section extending from the plane section 125*a*. The curved section may be wound in a circumferential direction to have a scroll-like shape. The convex part 140 may be formed within the curved section.

The fan housing 120 may be configured to have a scroll-shaped flow path (hereinafter, referred to as "scroll flow path"). The scroll flow path may be defined by the first plate 122, the second plate 124, and the sidewall 125, and provided outside of the impeller 110. With such configuration, air may move along the scroll flow path due to rotation of the impeller 110.

Herein, a gap between one of outer ends (namely, tailing edges of the blades 122 and 114 in which air current is separated from the blades 122 and 114) of the impeller 100 and an inner circumferential surface of the sidewall 125 is understood to be a width of the flow path. The width of flow path may gradually decrease from the plane section 125*a* to a point F where the scroll flow path is terminated. The minimum width of the flow path is preferably at the point F. Hereinafter, the point F where the scroll flow path is terminated is understood to be a cut-off point. In the sidewall 125, a section 125*b* from the cut-off point F to the outlet 127 is a section (hereinafter, referred to as "diffusion section") for guiding air current to the outlet 127. The diffusion section may be gradually distanced away from the plane section 125*a* toward the outlet 127.

The first plate 122 and the second plate 124 may have substantially identical shapes, and may have outer circumferences S corresponding to each of the sections of the sidewall 125, respectively. In particular, for example, each outer circumference S may be divided into a straight section S1 corresponding to the plane section 125*a*, a curved section S2 corresponding to the scroll flow path while expanding from the straight section S1 to the cut-off point F, and an extended section S3 corresponding to the diffusion section 125*b*—while gradually expanding from the cut-off point F to the outlet 127.

The outer circumference S of the first plate 122 and the outer circumference of the second plate 124 may have substantially identical shapes. For example, when viewed from the rotation axis C, the outer circumferences of the first and second plates 122 and 124 may completely overlap with each other.

In the curved section S2 constituting the outer circumference S, a distance from the rotation axis C may gradually decrease toward the cut-off point F from a point connected to the straight section S1. For example, the curved section S2 may form a spiral of Archimedes or a logarithmic spiral. However, the invention is not limited thereto.

As illustrated in FIG. 3, a rotation direction ω of the impeller 110 is a counterclockwise direction on the rotation axis C. Herein, an angle θ which is increased in an opposite direction to the rotation direction ω of the impeller 110 is defined. In this case, a reference for the angle θ is determined at a boundary)(θ=0° encountering the plane section 125*a* to the convex part 140.

Arbitrary cross-sectional surfaces (e.g., cross-sectional surfaces illustrated in FIG. 4) are provided by cutting the convex part 140 in a parallel direction with the rotation axis C. Each point (hereinafter, referred to as "a maximum convex point") of the inner circumferential surface of the convex part 140, which has a maximum distance from the rotation axis C, is positioned closer to the first plate 122 than the second plates 122 and 124. As shown, a curve M connecting the maximum convex points on the cross-sectional surfaces may be disposed on a common plane that is perpendicular to the rotation axis C. The common plane may be disposed at a height substantially corresponding to the main plate 11.

As illustrated in the drawings, the curve M connecting the maximum convex points may be disposed on a plane parallel with the main plate 111. Hereinafter, the curve M is referred to as a "maximum convex curve."

The convex part 140 formed at the sidewall 125 may extend to the inner space of the scroll flow path such that air current forced by the impeller 110 may be smoothly transferred. In this configuration, for example, air exhausted by the impeller 110 does not rapidly collide with an inner surface of the convex part 140 and a direction of air is smoothly switched along the inner surface. Thus, there is a decreased loss of airflow and an improved efficiency of the air blower.

Furthermore, air forced by the impeller 110 may be uniformly diffused along the entire convex part 140. Thereby, velocity gradient of air more smoothly occurs along the scroll flow path and thus, noise due to the above described problems is decreased.

Additionally, air flows well in the convex part 140 such that pressure loss is prevented while a conversion from dynamic pressure to static pressure is superior. Thus, high pressure may be maintained not only at the inner circumferential surface of the sidewall 125 but also at the entire fan housing 120.

Meanwhile, as viewed on the cross-sectional surfaces, the inner surface of the convex part 140 may be formed to have a curved shape expanding from the maximum convex point (or, the maximum convex curve M) to both ends. Because the maximum convex point is closer to the first plate 122 than the second plate 124, in the curve forming the inner circumferential surface of the convex part 140 (as viewed on the cross-sectional surfaces), a gradient from the maximum convex point to the first plate 122 is greater than a gradient from the maximum convex point to the second plate 124.

Furthermore, in the cross-sectional surfaces of the convex part 140, the maximum convex point is closer to the first plate 122 than the second plate 124 such that each first blade 112 may be formed to have a shorter length than each second blade 114. Thus, for example, a distance from the first rim 113 to the main plate 111 is less than a distance from the second rim 115 to the main plate 111.

The motor 171 may be disposed outside the fan housing 120, preferably, at the first inlet 122*h* side. Thus, when the impeller 110 is rotated, air is introduced to the fan housing 120 through the first inlet 122*h* and the second inlet 124*h*. In this case, however, in the first inlet 122*h* side, the motor 171 operates as a resistance impeding smooth flow of air. If a distance between the first plate 122 and the maximum convex point is the same as a distance between the second plate 124 and the maximum convex point, an unbalance between air amount suctioned through the first inlet 122*h* and air amount suctioned through the second inlet 124*h* occurs. In addition, rotation of the impeller 110 is not balanced due to the difference of suctioned air amount and, as such, unnecessary noise increases, and efficiency or performance of the air blower decreases.

Thus, according to an embodiment of the invention, because the air blower 100*a* is formed such that the maximum convex point is formed adjacent to the first inlet 122*h*, the air amount suctioned through the first inlet 122*h* is balanced with the air amount suctioned through the second inlet 124*h*, which is not the case for a configuration wherein the distance between the first plate 122 and the maximum convex point is the same as a distance between the second plate 124 and the maximum convex point.

Particularly, for example, when the maximum convex point is disposed adjacent to the first inlet 122*h*, a gap between the first blade 122 and the inner surface of the convex part 140 rapidly expands toward the main plate 111 from the first inlet 122*h*. As a result, air may be more smoothly suctioned through the first inlet 122*h*. The motor operates as a resistance to the airflow at the first inlet 122*h* side, so that the above structure compensates for a decrease of air amount suctioned through the first inlet 122*h*. Thereby, air may be uniformly suctioned through the first inlet 122*h* and the second inlet 124*h*.

FIG. 3 shows positions at every 90 degrees in a rotation direction ω of the impeller 110 on the basis of a point θ=0° where the convex part 140 and the plane section 125*a* are encountered according to an embodiment of the disclosure. FIG. 4(*a*) is a cross-sectional view at a point of θ=90° in the air blower 110*a* taken along line A-A of FIG. 3. FIG. 4(*b*) is a cross-sectional view at a point of θ=180° in the air blower 110*a* taken along line B-B of FIG. 3. FIG. 4(*c*) is a cross-sectional view at a point of θ=270° in the air blower 110*a* taken along line A-A of FIG. 3. FIG. 4(*d*) is a cross-sectional view at a point of θ=0° in the air blower 110*a* taken along line B-B of FIG. 3.

Referring to FIGS. 3 and 4(*a*)-(*d*), the cut-off point F is disposed near a point of θ=90°. In an opposite side to the cut-off point F based on a rotation central point of the impeller 110, the maximum convex point is disposed at the farthest point from the rotation axis C. The maximum convex point is disposed between a point of θ=180° and a point of θ=360°. In the illustrated embodiment, for example, the maximum convex point is disposed in the proximity of a point of θ=270°. However, the invention is not limited thereto.

Referring to FIGS. 3 and 4(*a*)-(*d*), the convex part 140 starts between a point of θ=90° and a point of θ=180°. The maximum convex point is gradually distanced from the rotation axis C up to a certain point. The radius of curvature of the maximum convex curve M gradually decreases from a point where the convex part 140 starts (see FIG. 4(*a*)). Then, the radius of curvature of the maximum convex curve M gradually increases to a point (see FIG. 4(*d*)) where the convex part 140 terminates after passing through the maximum convex point P (see FIG. 4(*c*)) where a distance from the rotation axis C is maximum (R1>R2, R2=minimum radius of curvature). Reference numerals 140*a*, 140*b*, 140*c*, and 140*c* indicate the convex part in the cross-sectional views 4(*a*), 4(*b*), 4(*c*), and 4(*d*), respectively.

Figure 5A:
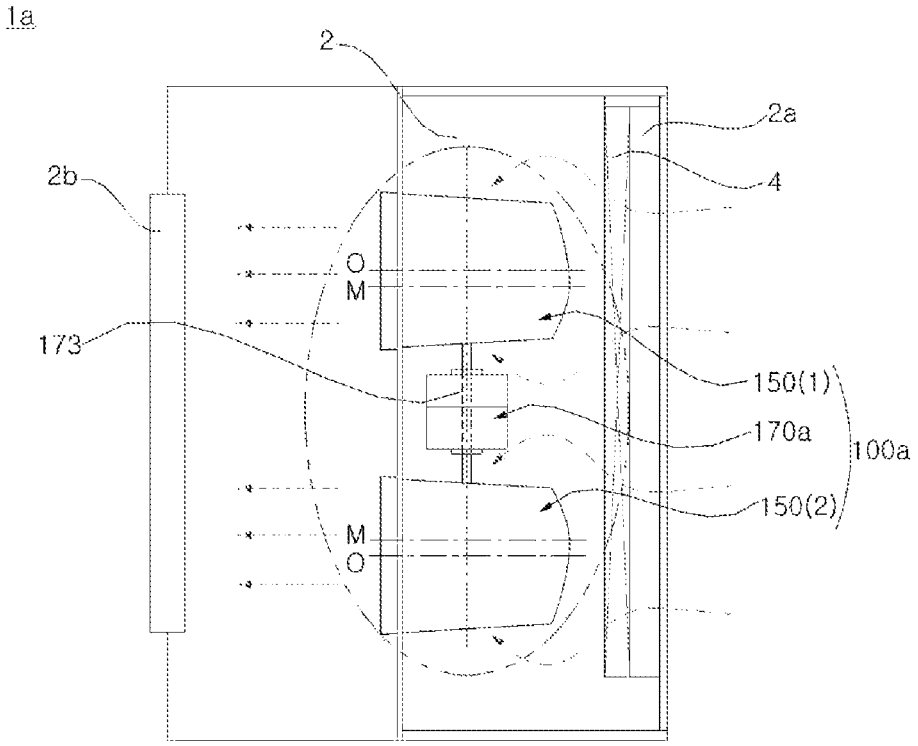
FIG. 5(*a*) is a view illustrating an air conditioner according to an embodiment of the present disclosure.
Figure 5B:
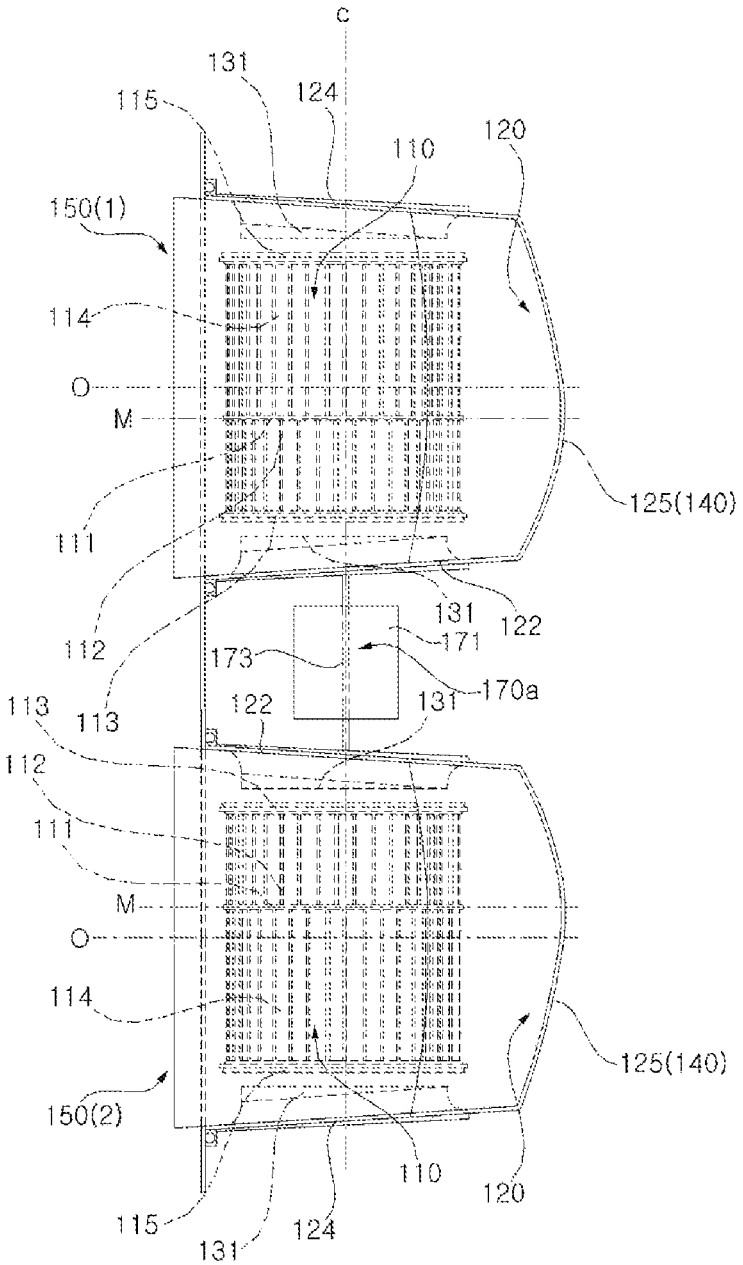

FIG. 5(*a*) is a view illustrating an air conditioner according to an embodiment of the present disclosure. FIG. 5(*b*) is a partially enlarged view of FIG. 5(*a*).

Referring to FIGS. 5(*a*) and 5(*b*), the air conditioner 1*a* exhausts cooled air or heated air to condition indoor air. The air conditioner 1*a* may include a driver 170*a*, and an air blower 110*a* including a first centrifugal fan 150(1) and a second centrifugal fan 150(2) driven by the driver 170*a*.

The first centrifugal fan 150(1) and the second centrifugal fan 150(2) may be identical to the centrifugal fan 150 as described above with respect to the embodiment illustrated in FIGS. 1 through 4(*a*)-(*c*). In the embodiment shown in FIGS. 5(*a*) and 5(*b*), both centrifugal fans 150(1) and 150(2) are symmetrical to a certain reference line L, which is disposed between both centrifugal fans 150(1) and 150(2). Hereinafter, for purposes of convenience, the same components as the above-described components are given the same reference numerals and further descriptions thereof are omitted.

As illustrated, the air conditioner 1*a* includes a casing 2 providing a space to accommodate the air blower 110*a*. The casing 2 may also accommodate a heat exchanger 4. The casing 2 may include an intake port 2*a* suctioning external air (indoor or outdoor air) and a conditioned air exhaust port 2*b* contacting to the heat exchanger 4 while exhausting temperature-controlled air to an indoor space. Air suctioned into the casing 2 through the intake port 2*a* thus passes through the heat exchanger 4 to control the temperature of air. Then, air forced by the air blower 100*a* may be exhausted through the conditioned air exhaust port 2*b* to the indoor space.

The air conditioner 1*a* may include a heat pump. Here, the heat exchanger 4 constitutes the heat pump. The heat exchanger 4 cools or heats air, which is suctioned to the centrifugal fans 150(1) and 150(2), using heat exchange of air in the casing 2.

The heat pump circulates a coolant using a compressor (not shown) along an enclosed pipe forming a closed loop. The heat exchanger 4 may be a part of the enclosed pipe. In this case, for example, the coolant exchanges heat with air of the casing 2 while passing through the heat exchanger 4.

In a process of circulation of the coolant along the pipe, the air conditioner 1*a* may include a heat pump for passing through a series of phase change processes including compression, expansion, evaporation, and condensation. In this case, for example, upon cooling the indoor space (an air conditioner only for cooling or in a cooling mode of an air conditioner for cooling or heating), the heat exchanger 4 operates as an evaporator to evaporate the coolant. Upon heating the indoor space (an air conditioner only for heating or in a heating mode of an air conditioner for cooling or heating), the heat exchanger 4 operates as a condenser to condense the coolant.

Embodiments are not limited thereto. The air conditioner 1*a* according to the present disclosure may include known various types heaters or coolers to heat or cool air of the casing 2.

The driver 170*a* is commonly used to drive the first centrifugal fan 150(1) and the second centrifugal fan 150(2). The driver 170*a* includes a common motor 171 disposed between the first centrifugal fan 150(1) and the second centrifugal fan 150(2), and a driving shaft 173 expanding from both ends of the motor 171. One end of the driving shaft 173 is connected to an impeller 110 of the first centrifugal fan 150(1). The other end of the driving shaft 173 is connected to an impeller 110 of the second centrifugal fan 150(2).

The first inlets 122*h* of the first and second centrifugal fans 150(1) and 150(2) face to each other such that the motor 171 is interposed therebetween. Thus, when air current is suctioned through the first inlet 122*h*, the motor 171 operates as a resistance to the airflow. However, in each of centrifugal fans 150(1) and 150(2), the maximum convex point (or the maximum convex curve M) of a convex part 140 of a fan housing 120 leans toward a first plate 122 such that air amount suctioned through the first inlet 122*h* increases. Thereby, in each of the centrifugal fans 150(1) and 150(2), air may be uniformly suctioned through the first inlet 122*h* and a second inlet 124*h*.

Meanwhile, unlike the illustrated embodiment, the driver 170*a* may include at least two motors for driving the first centrifugal fan 150(1) and the second centrifugal fan 150(2), respectively. The motors may be disposed between the first centrifugal fan 150(1) and the second centrifugal fan 150(2).

Figure 6A:
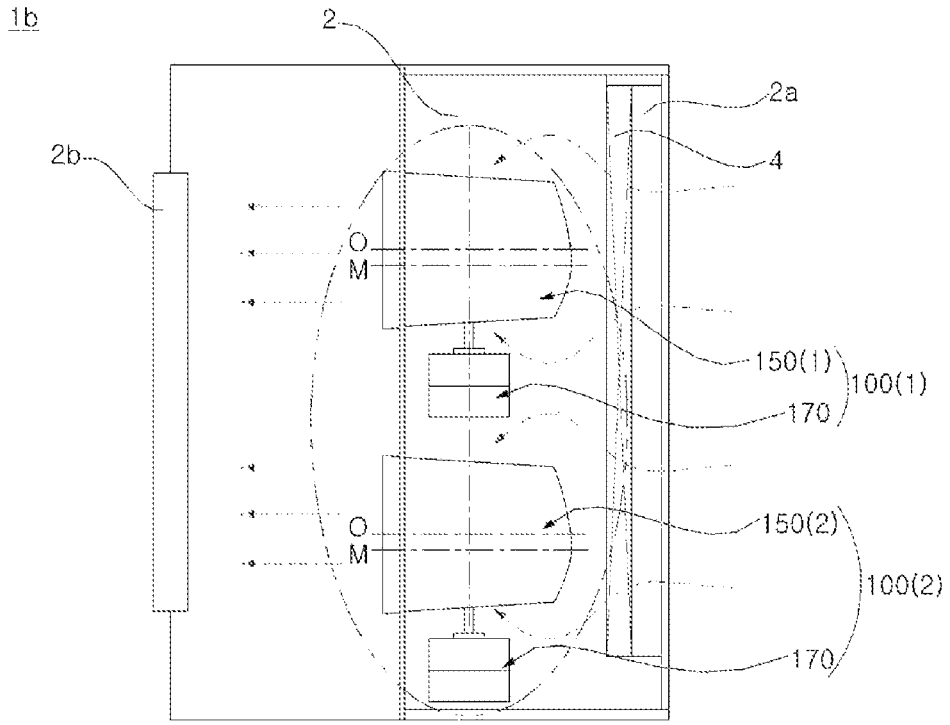
FIG. 6(*a*) is a view illustrating an air conditioner according to another embodiment of the present disclosure.
Figure 6B:
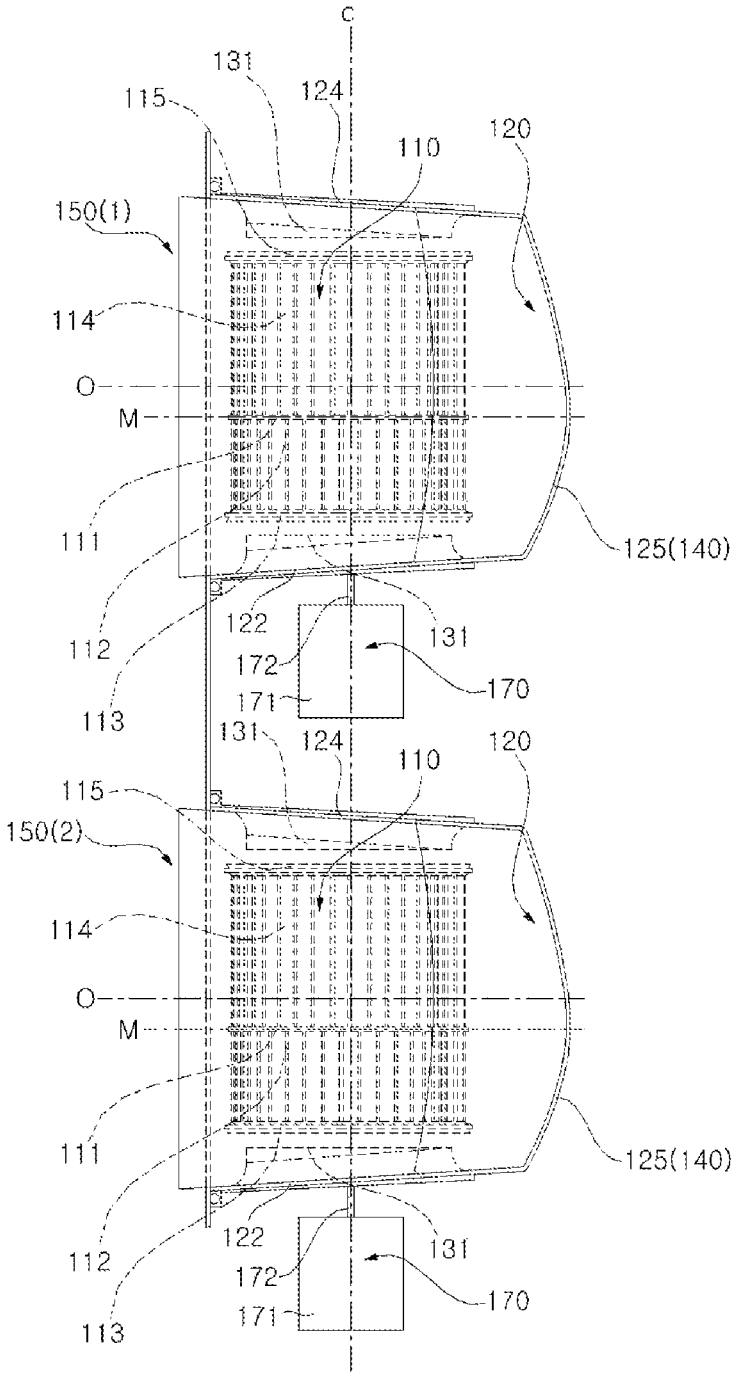

FIG. 6(*a*) is a view illustrating an air conditioner according to another embodiment of the present disclosure. FIG. 6(*b*) is a partially enlarged view of FIG. 6(*a*). Referring to FIGS. 6(*a*) and 6(*b*), an air conditioner 1*b* may include a first air blower 100(1) and a second air blower 100(2). The first air blower 100(*a*) and the second air blower 100(2) may each have a substantially identical structure to an air blower 100 as described with respect to the embodiment illustrated in FIGS. 1 through 4(*a*)-(*c*).

The drivers 170 may be provided to each of the first air blower 100(*a*) and the second air blower 100(2), respectively. A motor is disposed at a first inlet 122*h* side of each of the first air blower 100(*a*) and the second air blower 100(2). The centrifugal fans 150 of the first air blower 100(*a*) and the second air blower 100(2) may be aligned so as to have a common rotation axis.

The air conditioner 1*b* may include a first motor driving the first centrifugal fan 100(1) that is disposed adjacent to the second inlet 124*h* of the second centrifugal fan 100(2) such that the first motor acts as a resistance to the airflow in a process of suctioning air through the second inlet 124*h* of the second air blower 100(2). Because the maximum convex point (or the maximum convex curve M) leans toward a first plate 122 (i.e., the curve M is closer to the first plate 122 than the second plate 124), a gap between the second plate 124 and the main plate 111 is large enough to flow air forced by the second blades 144. Accordingly, the decrease of air suctioned through the second inlet 124*h* is not significant and the air is uniformly suctioned through both inlets 122*h* and 124*h* of the second air blower 100(2).

As apparent from the above description, in accordance with the air blower and the air conditioner of the present disclosure, because air is uniformly suctioned through both inlets, the rotation of the impeller is balanced. Thus, even when resistance of the airflows at both inlets is different, air current may be uniformly suctioned through both inlets due to an arrangement of the motor. Moreover, the configurations of the present invention prevent generation of abnormal noise.

Although the preferred embodiments of the present disclosure have been disclosed for illustrative purposes, those skilled in the art will appreciate that various modifications, additions and substitutions are possible, without departing from the scope and spirit of the invention as disclosed in the accompanying claims.

What is claimed is:

1. An air blower comprising:

a rotatable impeller;

a fan housing that accommodates the impeller, the fan housing comprising:

a first inlet and a second inlet that each suction air current along a rotation axis of the impeller, and an outlet exhausting air current in a direction perpendicular to the rotation axis;

a motor provided outside of the fan housing; and a driving shaft that extends along the rotation axis and is connected to the impeller, the driving shaft being rotated by the motor, wherein, the fan housing comprises:

a first plate that includes the first inlet;

a second plate that includes the second inlet, and a sidewall connected to the first plate and the second plate, the sidewall extending at an outer side of the impeller in a circumferential direction to guide the air suctioned through the first and second inlets to the outlet;

the impeller comprises:

a main plate attached to the driving shaft, the main plate having a first side that faces the first inlet and a second side that faces the second inlet, a plurality of first blades arranged at the first side in a circumferential direction, and a plurality of second blades arranged at the second side in a circumferential direction, and the motor is disposed at the first inlet side, and the sidewall comprises a convex part that protrudes away from the rotation axis, whereby arbitrary cross-sectional surfaces are provided by cutting the convex part in a parallel direction with the rotation axis such that in each cross-sectional surface, each of points of an inner circumferential surface of the convex part is located closer to the first plate than to the second plate, wherein each of the first blades has a shorter length than each of the second blades, wherein:

the impeller comprises a first rim connected to one end of each of the first blades and a second rim connected to one end of each of the a plurality of second blades, the first and second rims are arranged at opposite sides of the main plate, and a distance from the first rim to the main plate is shorter than a distance from the second rim to the main plate.

2. The air blower of claim 1, wherein, in the arbitrary cross-sectional surfaces, the points of the inner circumferential surface of the convex part, each of which has a maximum distance from the rotation axis, are disposed at a plane that is parallel to the main plate.

3. The air blower of claim 1, wherein the sidewall comprises a curved section that curves in a circumferential direction, and the convex part is formed at the curved section.

4. The air blower of claim 3, wherein the sidewall further comprises a plane section that extends from the curved section to the outlet, and the inner circumferential surface of the convex part is farthest away from the rotation axis between a point encountering the curved and plane sections and a point of 180 degrees, from the point encountering the curved and plan, in an opposite direction to the rotation direction of the impeller in a circumferential direction.

5. The air blower of claim 4, wherein:

in the cross-sectional surfaces, the point, where the inner circumferential surface is farthest away from the rotation axis, is gradually distanced from the rotation axis in a rotation direction of the impeller to the point, where the inner circumferential surface is farthest away from the rotation axis, and the point gradually approaches to the plane section from the point where the inner circumferential surface is farthest away from the rotation axis.

6. The air blower of claim 4, wherein the inner circumferential surface of the convex part has a minimum radius of curvature at the point where the inner circumferential surface is farthest away from the rotation axis.

7. The air blower of claim 1, wherein the main plate is arranged closer to the first plate than the second plate.

8. An air conditioner comprising the air blower of claim 1.

9. The air conditioner of claim 3, wherein the curved section that curves in the circumferential direction has a scroll shape.

10. The air conditioner of claim 1, wherein the second plate provides a space between the first plate and the second plate to accommodate the impeller.

11. An air blower comprising:

a motor; and a first centrifugal fan and a second centrifugal fan, the first and second centrifugal fans respectively disposed at opposite sides of the motor and rotated by the motor, wherein each of the first and second centrifugal fans comprises:

a rotatable impeller, and a fan housing to accommodate the impeller, the fan housing comprising:

a first inlet and a second inlet that each suction air current along a rotation axis of the impeller, and an outlet that exhausts air current in a direction perpendicular to the rotation axis, and wherein, the fan housing comprises:

a first plate that includes the first inlet, a second plate that includes the second inlet, and a sidewall connected to the first plate and the second plate, the sidewall extending at an outer side of the impeller in a circumferential direction to guide air suctioned through the first and second inlets to the outlet, the impeller comprises:

a main plate attached to a driving shaft rotated by the motor, the main plate having a first side facing the first inlet and a second side facing the second inlet, a plurality of first blades arranged at the first side in a circumferential direction, and a plurality of second blades arranged at the second side in a circumferential direction, the sidewall comprises a convex part that protrudes away from the rotation axis, and the first and second inlets of the first and second centrifugal fans are respectively disposed at opposite sides of the motor, whereby arbitrary cross-sectional surfaces are provided by cutting the convex part in a parallel direction with the rotation axis such that in each cross-sectional surface, each of points of an inner circumferential surface of the convex part is located closer to the first plate than to the second plate, wherein, each of the first blades has a shorter length than each of the second blades, wherein:

the impeller comprises a first rim connected to one end of each of the first blades and a second rim connected to one end of each of the plurality of second blades, the first and second rims are arranged at opposite sides of the main plate, and a distance from the first rim to the main plate is shorter than a distance from the second rim to the main plate.

12. An air conditioner comprising the air blower of claim 11.

* * * * *